US010901339B2

(12) United States Patent
Watanabe et al.

(10) Patent No.: US 10,901,339 B2
(45) Date of Patent: Jan. 26, 2021

(54) IMAGE FORMING APPARATUS WHICH SUPPRESSES IMAGE DEFECTS DUE TO INTERFERENCE BETWEEN A CHARGING ALTERNATING-CURRENT FREQUENCY AND A DEVELOPING ALTERNATING-CURRENT FREQUENCY

(71) Applicant: KYOCERA Document Solutions Inc., Osaka (JP)

(72) Inventors: Takuji Watanabe, Osaka (JP); Norio Tomiie, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/737,479

(22) Filed: Jan. 8, 2020

(65) Prior Publication Data

US 2020/0241441 A1 Jul. 30, 2020

(30) Foreign Application Priority Data

Jan. 30, 2019 (JP) ..... 2019-013794

(51) Int. Cl.
*G03G 15/06* (2006.01)
*G03G 15/02* (2006.01)
*G03G 15/00* (2006.01)

(52) U.S. Cl.
CPC ..... *G03G 15/065* (2013.01); *G03G 15/0283* (2013.01); *G03G 15/80* (2013.01); *G03G 15/0216* (2013.01)

(58) Field of Classification Search
CPC ..... G03G 15/065; G03G 15/0216; G03G 15/0225; G03G 15/0266; G03G 15/0283; G03G 15/80; G03G 15/0907
See application file for complete search history.

(56) References Cited

U.S. PATENT DOCUMENTS 4,447,517 A * 5/1984 Yuge ..... G03G 15/0907 324/173
5,444,519 A * 8/1995 Motoyama ..... G03G 15/0283 323/283

(Continued)

FOREIGN PATENT DOCUMENTS

JP 2007199377 A * 8/2007
JP 2011-59311 A 3/2011

*Primary Examiner* — Walter L Lindsay, Jr.
*Assistant Examiner* — Laura Roth
(74) *Attorney, Agent, or Firm* — Stein IP, LLC

(57) ABSTRACT

An image forming apparatus has a bias controller. The bias controller varies both a charging alternating-current frequency, which is the frequency of a charging alternating-current voltage, and a developing alternating-current frequency, which is the frequency of the developing alternating-current voltage. When the region of the charging and developing alternating-current frequencies in which interference fringes appear in a developed image due to interference between the charging and developing alternating-current frequencies is taken as a variation region and the variation speeds of the charging and developing alternating-current frequencies in the variation region are taken as a first and a second variation speed respectively, the bias controller varies the charging and developing alternating-current frequencies such that one of the first and second variation speeds is a positive-number multiple of the other.

5 Claims, 6 Drawing Sheets

(56) References Cited

U.S. PATENT DOCUMENTS

| | | | | |
|---|---|---|---|---|
| 2011/0058833 | A1 | 3/2011 | Yoshimoto | 399/50 |
| 2020/0241436 | A1* | 7/2020 | Watanabe | G03G 15/065 |

* cited by examiner

IMAGE FORMING APPARATUS WHICH SUPPRESSES IMAGE DEFECTS DUE TO INTERFERENCE BETWEEN A CHARGING ALTERNATING-CURRENT FREQUENCY AND A DEVELOPING ALTERNATING-CURRENT FREQUENCY

INCORPORATION BY REFERENCE

This application is based on and claims the benefit of Japanese Patent Application No. 2019-013794 filed on Jan. 30, 2019, the contents of which are hereby incorporated by reference.

BACKGROUND

The present disclosure relates to an image forming apparatus in which AC-type biasing is adopted for charging or development.

An image forming apparatus of an electrophotographic type employs a charger of a contact type that performs electrostatic charging by bringing a charging member having a voltage applied to it into contact with the surface of an image carrying member (to-be-charged member) such as a photosensitive drum. Electrostatic charging of a to-be-charged member by use of a charger of a contact type divides into DC charging and AC charging. In DC charging, as a charging bias, only a direct-current voltage Vdc is applied to the to-be-charged member to electrostatically charge the to-be-charged member. On the other hand, in AC charging, a charging bias having an alternating-current voltage Vac superposed on the direct-current voltage Vdc is applied to the to-be-charged member to electrostatically charge the to-be-charged member. AC charging is favored in recent years because, as compared with DC charging, it is effective in achieving uniform charging owing to the alternating-current component suppressing the variation of the charging voltage.

In AC charging, a charging bias that contains an alternating-current voltage Vac is applied to the to-be-charged member. This leads to the known problem of image defects in which interference fringes appear in the developed image due to the difference between the alternating-current frequency of the charging bias (in the present disclosure, referred to also as the "charging alternating-current frequency") and the alternating-current frequency of the developing bias (in the present disclosure, referred to also as the "developing alternating-current frequency") that is applied to the developer carrying member in the developing device.

As a solution, in one known configuration, prevention of the interference fringes is attempted by variably controlling the charging alternating-current frequency while keeping the developing alternating-current frequency in a frequency ratio of a multiple of an integer to the charging alternating-current frequency.

SUMMARY

According to one aspect of the present disclosure, an image forming apparatus includes: a charging device that applies to a charging member a charging bias having a charging alternating-current voltage superposed on a charging direct-current voltage and that brings the charging member close to or into contact with an image carrying member to electrostatically charge the surface of the image carrying member; an electrostatic latent image forming device that forms an electrostatic latent image on the surface of the image carrying member electrostatically charged by the charging device; a developing device that develops the electrostatic latent image on the surface of the image carrying member with a developing bias having a developing alternating-current voltage superposed on a developing direct-current voltage; and a bias controller that varies both a charging alternating-current frequency, which is the frequency of the charging alternating-current voltage, and a developing alternating-current frequency, which is the frequency of the developing alternating-current voltage. When a region of the charging and developing alternating-current frequencies in which interference fringes appear in a developed image due to interference between the charging and developing alternating-current frequencies is taken as a variation region and the variation speeds of the charging and developing alternating-current frequencies in the variation region are taken as a first and a second variation speed respectively, the bias controller varies the charging and developing alternating-current frequencies such that one of the first and second variation speeds is a positive-number multiple of the other.

This and other objects of the present disclosure, and the specific benefits obtained according to the present disclosure, will become apparent from the description of embodiments which follows.

DETAILED DESCRIPTION

In a configuration that attempts to prevent interference fringes by variably controlling a charging alternating-current frequency while keeping a developing alternating-current frequency in a frequency ratio of a multiple of an integer to the charging alternating-current frequency, to suppress image defects due to interference, it is necessary to perform highly accurate control such that the charging and developing alternating-current frequencies are in constant proportions. This requires a high-performance controller, and leads to increased cost of the circuit board on which the controller and its peripheral components (e.g., a storage) are mounted. Moreover, the need to design a circuit board specialized for highly accurate control leads to narrow design tolerances in the circuit board. Thus, considering the cost of and the design tolerances in the circuit board, it is desirable to suppress, by simple control, the image defects due to interference between the charging and developing alternating-current frequencies.

The present disclosure provides an image forming apparatus that can suppress, with simple control, the image defects due to interference between a charging alternating-current frequency and a developing alternating-current frequency in a configuration where the charging and developing alternating-current frequencies are both varied. Hereinafter, an embodiment of the present disclosure will be described with reference to the accompanying drawings.

[Outline of the Structure of an Image Forming Apparatus]

Figure 1:
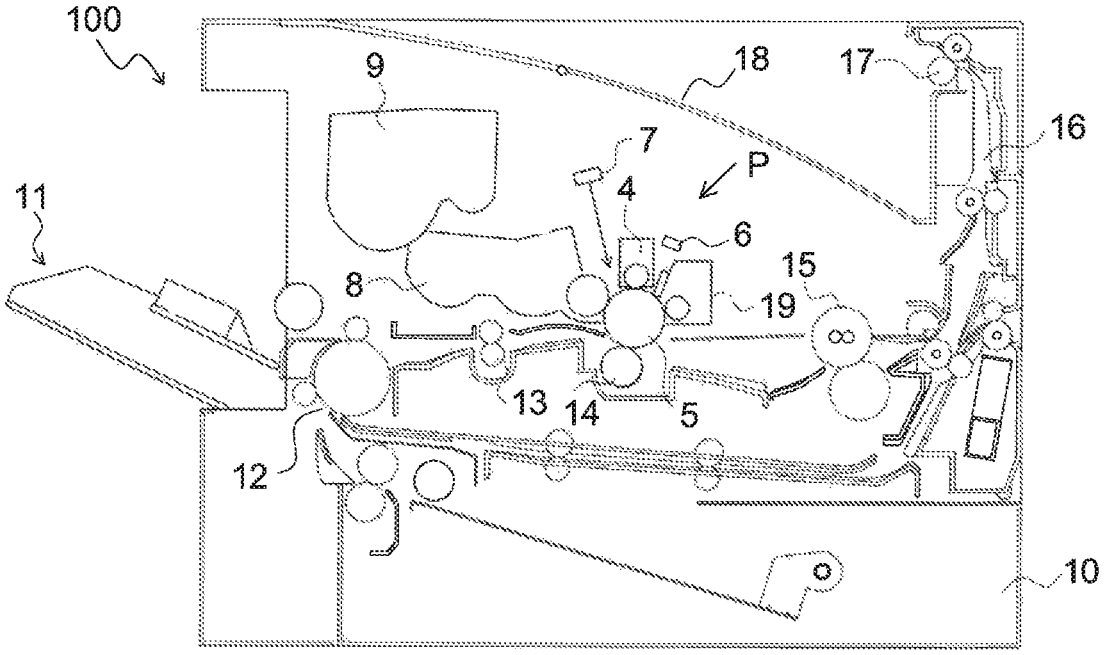
FIG. 1 is a sectional view showing the internal construction of an image forming apparatus according to one embodiment of the present disclosure.

FIG. 1 is a sectional view showing the internal construction of an image forming apparatus 100 (here, a monochrome printer) according to one embodiment of the present disclosure. Inside the image forming apparatus 100, there is disposed an image forming section P that forms a monochrome image through the processes of charging, exposure, development, and transfer. In the image formation section P are disposed, along the rotation direction (counter-clockwise in FIG. 1) of a photosensitive drum 5 as an image carrying member, a charging device 4, an exposure unit 7 as an electrostatic latent image forming device, a developing device 8, a transfer roller 14, a cleaning device 19, and a destaticizing device 6.

The photosensitive drum 5 is, for example, an amorphous silicon photoconductor that has an amorphous silicon layer, which is a positively chargeable photoconductor, as a photosensitive layer formed by deposition on the surface of a drum base tube made of aluminum, and has a diameter of about 30 mm. The photosensitive drum 5 is configured to be driven to rotate at a constant speed about a pivot shaft by a drum driver (not shown).

During image forming operation, the photosensitive drum 5 rotating counter-clockwise is electrostatically charged by the charging device 4 uniformly. Subsequently, with a laser beam based on document image data and shone from the exposure unit 7, an electrostatic latent image is formed on the photosensitive drum 5. Then, developer (hereinafter referred to as toner) is attached to the electrostatic latent image by the developing device 8 to form a toner image. The document image data mentioned above is transmitted from a host device such as a personal computer (not shown). Toner is supplied to the developing device 8 from a toner container 9.

On the other hand, toward the photosensitive drum 5 on which the toner image has been formed, a sheet (recording medium) is conveyed from a sheet feed cassette 10 or from a manual feeding device 11 via a sheet conveying passage 12 and a pair of registration rollers 13. Then, by the transfer roller 14, the toner image formed on the surface of the photosensitive drum 5 is transferred to the sheet. The toner that remains on the surface of the photosensitive drum 5 is removed by the cleaning device 19. Then, the electric charge that remains on the surface of the photosensitive drum 5 is removed by the destaticizing device 6.

The sheet having the toner image transferred to it is separated from the photosensitive drum 5, and is conveyed to a fixing device 15, where the toner image is fixed. The sheet having passed through the fixing device 15 is conveyed through a sheet conveying passage 16 to an upper part of the image forming apparatus 100, and is discharged by a pair of discharge rollers 17 onto a discharge tray 18.

[Details of the Image Forming Section]

Figure 2:
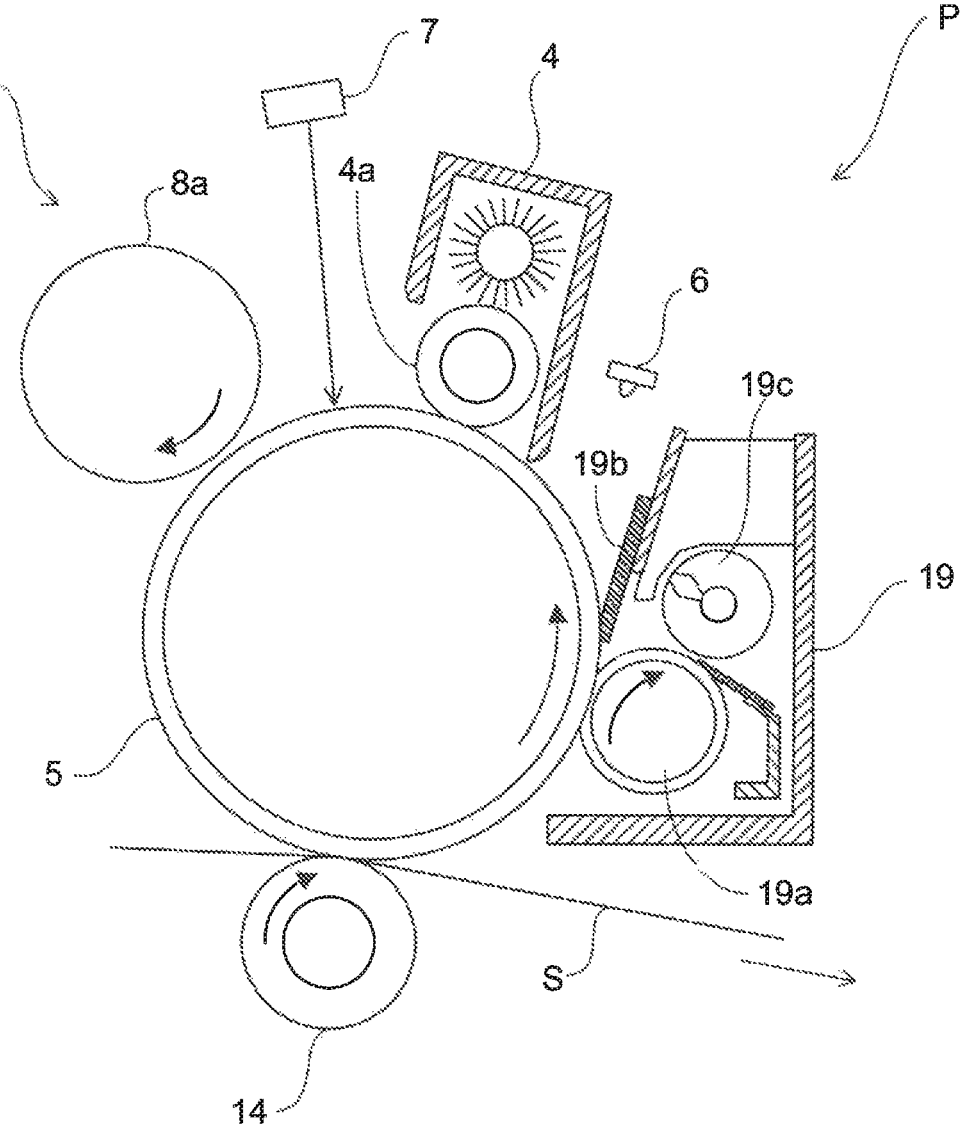
FIG. 2 is a sectional view showing an image forming section in the image forming apparatus on an enlarged scale.

Next, the image forming section P mentioned above will be described in detail. FIG. 2 is a sectional view showing the image forming section P mentioned above on an enlarged scale. The charging device 4 is a charging device of a contact charging type, and has a charging roller 4*a* (charging member) that is arranged in contact with the surface of the photosensitive drum 5. The charging device 4, while applying a charging bias V1 to the charging roller 4*a*, makes the charging roller 4*a* rotate in contact with the photosensitive drum 5, and thereby electrostatically charges the surface of the photosensitive drum 5 to a predetermined potential.

The charging bias V1 is generated by superposing a charging alternating-current voltage V1*ac* on a charging direct-current voltage V1*dc*. Used as the alternating-current component of the charging bias V1 is, for example, a sinusoidal wave. The frequency of the alternating-current component of the charging bias V1 can be varied within a desired frequency width per unit period under the control of a bias controller 33 (see FIG. 3), which will be described later.

The exposure unit 7 performs, based on the document image data, exposure of the surface of the photosensitive drum 5 electrostatically charged by the charging device 4, and thereby forms an electrostatic latent image on the surface of the photosensitive drum 5. The exposure here is achieved by a method in which laser light is reflected by a rotating polygon mirror to scan the surface of the photosensitive drum 5. Accordingly, on the surface of the photosensitive drum 5, the electrostatic latent image is formed at a frequency that reflects the scanning pitch. In the present disclosure, this frequency is referred to also as the latent image frequency. The scanning pitch mentioned above corresponds to the resolution of the electrostatic latent image, and therefore the latent image frequency can be said to be a frequency that defines the resolution of the electrostatic latent image. The exposure unit 7 as an electrostatic latent image forming device can be any that can form an electrostatic latent image on the photosensitive drum 5 at a constant period through digital processing, and can be built with, for example, a MEMS or an LED array.

The developing device 8 has a developing roller 8*a*. The developing roller 8*a* feeds the toner stored in the toner container 9 in the developing device 8 to the photosensitive drum 5, and thereby develops the electrostatic latent image formed on the surface of the photosensitive drum 5. The toner that is fed from the developing roller 8*a* to the photosensitive drum 5 is, for example, toner having two parts by weight of titanium oxide (with a particle diameter of 0.1 μm and a resistance of $1\times10^7$ Ωcm) as an abrasive and 0.5 parts by weight of hydrophobic silica as a flow enhancer added to 100 parts by weight of toner particles.

Here, the feeding of toner from the developing roller 8*a* to the photosensitive drum 5 is achieved by the application of a developing bias to the developing roller 8*a* and the resulting formation of an electric field between the developing roller 8*a* and the photosensitive drum 5. The developing bias is generated by superposing together a developing direct-current voltage V2*dc* and a developing alternating-current voltage V2*ac*. Used as the alternating-current component of the developing bias is, for example, a rectangular wave. The frequency of the alternating-current component of the developing bias V2 can be varied within a desired frequency width per unit period under the control of the bias controller 33. The toner image developed on the photosensitive drum 5 is transferred to a sheet S by the transfer roller 14.

The cleaning device 19 includes a cleaning roller 19*a* made of foamed polyurethane, a cleaning blade 19*b*, and a toner collector 19*c*. The cleaning roller 19*a* and the cleaning blade 19*b* are arranged each in contact with the photosensitive drum 5. The toner collector 19*c* collects the toner removed from the photosensitive drum 5 by the cleaning roller 19*a* and the cleaning blade 19*b*. The cleaning roller 19*a* rotates with toner containing an abrasive present at where the cleaning roller 19*a* makes contact with the photosensitive drum 5; thus, the cleaning roller 19*a* rubs against the photosensitive drum 5 and thereby cleans the surface of the photosensitive drum 5.

[Controlling the Charging Bias and the Developing Bias]

Figure 3:
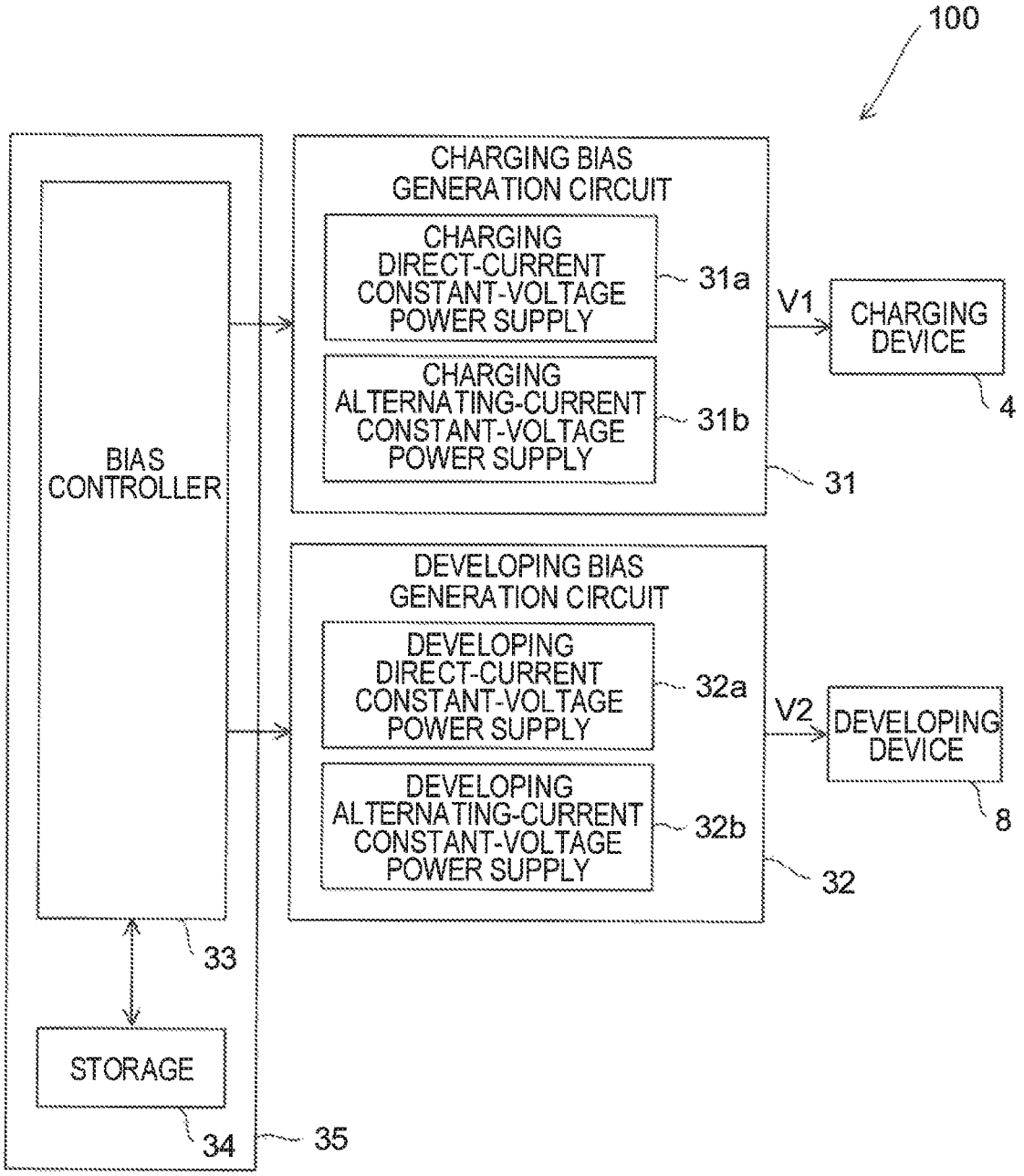
FIG. 3 is a block diagram schematically showing the configuration of a principal part of the image forming apparatus.

Next, how the charging bias V1 and the developing bias V2 mentioned above are controlled will be described. FIG. 3 is a block diagram schematically showing the configuration of a principal part of the image forming apparatus 100 according to the embodiment. The image forming apparatus 100 includes a charging bias generation circuit 31, a developing bias generation circuit 32, a bias controller 33, and a storage 34. The bias controller 33 and the storage 34 are mounted on a circuit board 35. The charging bias generation circuit 31 and the developing bias generation circuit 32 can be mounted on the circuit board 35, or can be mounted on a circuit board separate from the circuit board 35.

The storage 34 includes, for example, a ROM and a RAM, and stores a control program for operating the bias controller 33. Based on the control program, the bias controller 33 generates, for output to the charging bias generation circuit 31, a control signal (charging control signal) for generating the charging bias V1, and also generates, for output to the developing bias generation circuit 32, a control signal (development control signal) for generating the developing bias V2. The bias controller 33 so configured is, for example, built with a central processing unit (CPU).

The charging bias generation circuit 31 is a circuit that generates, based on the charging control signal from the bias controller 33, the charging bias V1 that is applied to the charging roller 4*a* in the charging device 4. The charging bias generation circuit 31 includes a charging direct-current constant-voltage power supply 31*a* and a charging alternating-current constant-voltage power supply 31*b*. The charging direct-current constant-voltage power supply 31*a* generates the charging direct-current voltage V1*dc* based on the above-mentioned charging control signal. The charging alternating-current constant-voltage power supply 31*b* generates the charging alternating-current voltage V1*ac* based on the charging control signal. In the charging bias generation circuit 31, the charging direct-current voltage V1*dc* and the charging alternating-current voltage V1*ac* are superposed together and thereby the charging bias V1 is generated. The charging roller 4*a* is electrostatically charged by being fed with the charging bias V1 from the charging bias generation circuit 31.

The developing bias generation circuit 32 is a circuit that generates, based on the development control signal from the bias controller 33, the developing bias V2 that is applied to the developing roller 8*a* in the developing device 8. The developing bias generation circuit 32 includes a developing direct-current constant-voltage power supply 32*a* and a developing alternating-current constant-voltage power supply 32*b*. The developing direct-current constant-voltage power supply 32*a* generates the developing direct-current voltage V2*dc* based on the above-mentioned development control signal. The developing alternating-current constant-voltage power supply 32*b* generates the developing alternating-current voltage V2*ac* based on the development control signal. In the developing bias generation circuit 32, the developing direct-current voltage V2*dc* and the developing alternating-current voltage V2*ac* are superposed together and thereby the developing bias V2 is generated. The developing bias V2 is applied to the developing roller 8*a*.

In the embodiment, the bias controller 33 performs control in which it varies both the charging alternating-current frequency, which is the frequency of the alternating-current component (charging alternating-current voltage V1*ac*) of the charging bias V1, and the developing alternating-current frequency, which is the frequency of the alternating-current component (developing alternating-current voltage V2*ac*) of the developing bias V2. Specifically, when the region of the charging and developing alternating-current frequencies in which the interference fringes appear in the developed image due to interference between the charging and developing alternating-current frequencies (i.e., the range in which the interference fringes appear) is taken as a variation region and the variation speeds of the charging and developing alternating-current frequencies in the variation region are taken as a first and a second variation speed respectively, then the bias controller 33 varies, in the variation region, the charging and developing alternating-current frequencies such that one of the first and second variation speeds is a positive-number multiple of the other (i.e., n times the other, where n is a positive integer of one or more).

Controlling the variation speeds (first and second variation speeds) of the charging and developing alternating-current frequencies in the variation region as described above helps reduce interference between the charging and developing alternating-current frequencies in the variation region, and thus makes the interference fringes due to the interference less visually recognizable. Thus, the control of the two frequencies no longer requires such high accuracy as conventionally required to keep the charging and developing alternating-current frequencies in constant proportions. Thus, it is possible to suppress the image defects due to interference between the charging and developing alternating-current frequencies with simpler control than conventionally practiced (with simple control where the variation speeds of the two frequencies are controlled).

Performing highly accurate control as conventionally practiced requires a high-performance (high-throughput) controller and a large-capacity storage, and this may cause concern for increased cost of the circuit board on which the controller and the storage are mounted. In contrast, the embodiment requires no such highly accurate control, and thus does not cause concern for increased cost of the circuit board 35 on which the bias controller 33 and the storage 34 are mounted. Nor is it necessary to design a circuit board 35 specialized for highly accurate control, and this allows wider design tolerances in the circuit board 35.

Incidentally, keeping the charging and developing alternating-current frequencies equal at the same frequency without varying either of them eliminates the image defects due to interference. However, the higher the rank of a model on the product line, the higher one of the charging and developing alternating-current frequencies; then the other too requires suitable control and a suitable circuit board design. This leads to increased cost of and narrower design tolerances in the circuit board 35.

Out of the considerations discussed above, the above-described control in this embodiment can be said to be more advantageous, in suppressing an increase in the cost of the circuit board 35 and in widening design tolerances in the circuit board 35, than the conventional control, where the two frequencies are kept in constant proportions.

It is particularly preferable that the bias controller 33 vary the charging and developing alternating-current frequencies such that the first and second variation speeds are equal. Making equal the variation speeds of the charging and developing alternating-current frequencies in the variation region makes the variable control of the two frequencies easier. Thus, it is possible to suppress, with simpler control, the image defects due to interference between the charging and developing alternating-current frequencies.

EXAMPLES

Assuming that the center frequency of the charging alternating-current frequency is 2700 Hz, consider a case where the charging alternating-current frequency is varied within ±200 Hz of the center frequency. Likewise, assuming that the center frequency of the developing alternating-current frequency is 2700 Hz, consider a case where the developing alternating-current frequency is varied within ±200 Hz of the center frequency. It has been known from various studies that, in a case where the charging and developing alternating-current frequencies are varied under such conditions, when the charging and developing alternating-current frequencies are in the range from 2650 to 2750 Hz, ordinarily (i.e., if the control according to the embodiment is not performed) visually recognizable the interference fringes appear in the developed image due to interference between the charging and developing alternating-current frequencies.

During the testing, the linear velocity of the photosensitive drum 5 was 152 mm/sec, the distance between the developing roller 8*a* and the photosensitive drum 5 was 0.3 mm, and the linear velocity ratio of the developing roller 8*a* to photosensitive drum 5 was 1.62; the charging direct-current voltage V1*dc* was 350 V, the charging alternating-current voltage V1*ac* was 1 kV on a peak-to-peak Vpp basis, the developing direct-current voltage V2*dc* was 180 V, and the developing alternating-current voltage V2*ac* was 1500 V on a peak-to-peak Vpp basis.

Figure 4:
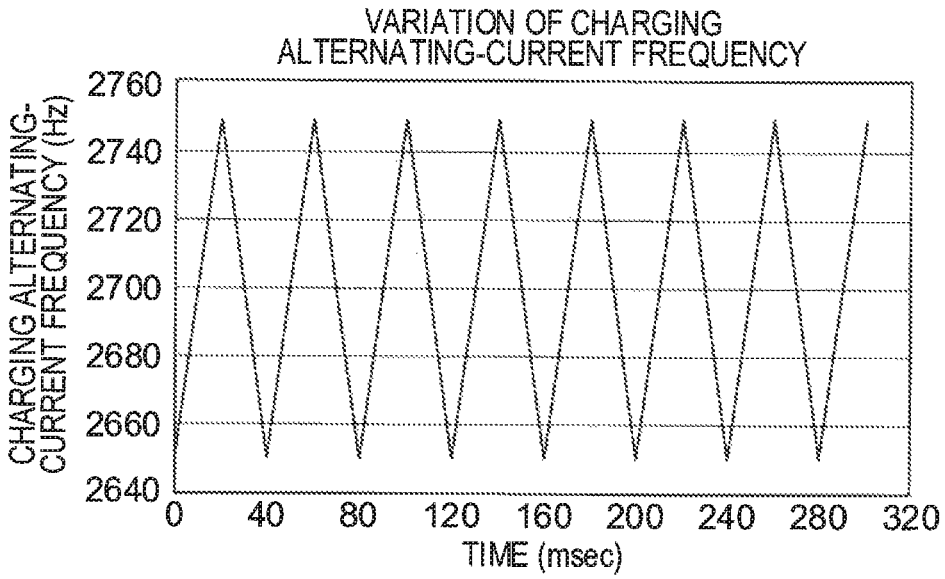
FIG. 4 is a plot showing variation of the charging alternating-current frequency.

Under the conditions mentioned above, the charging alternating-current frequency was varied, by spectrum spreading, in the range (variation region) from 2650 to 2750 Hz, across an amount of variation of 50 Hz for a duration of 10 msec. That is, the variation speed (first variation speed) of the charging alternating-current frequency in the variation region was 50 Hz/10 msec. FIG. 4 is a plot showing the variation of the charging alternating-current frequency in the variation region. On the other hand, the developing alternating-current frequency was varied, by spectrum spreading, in the range (variation region) from 2650 to 2750 Hz while its variation speed (second variation speed) in the variation region was selected among several speeds. Then, after development, the image transferred to a sheet was inspected for the interference fringes. The results are shown in Table 1.

TABLE 1

| | | | | | | |
|---|---|---|---|---|---|---|
| Charging Alternating-Current Frequency 1st Variation Speed (Hz/10 msec) | 50 | 50 | 50 | 50 | 50 | 50 |
| Developing Alternating-Current Frequency 2nd Variation Speed (Hz/10 msec) | 50 | 55 | 75 | 95 | 100 | 105 |
| Interference | No | Yes | Yes | Yes | No | Yes |

In Table 1, interference was evaluated as follows: when 80 or more in 100 people who saw an image recognized the interference fringes, interference was evaluated to be present ("Yes"); when 79 or less in 100 people who saw an image recognized the interference fringes, interference was evaluated to be absent ("No").

For different combinations of the first and second variation speeds, simulations of interference between the charging and developing alternating-current frequencies were performed, and the variation of the intensity of the composite wave of the charging and developing alternating-current frequencies was studied. The results are shown in FIG. 5.

Figure 5:
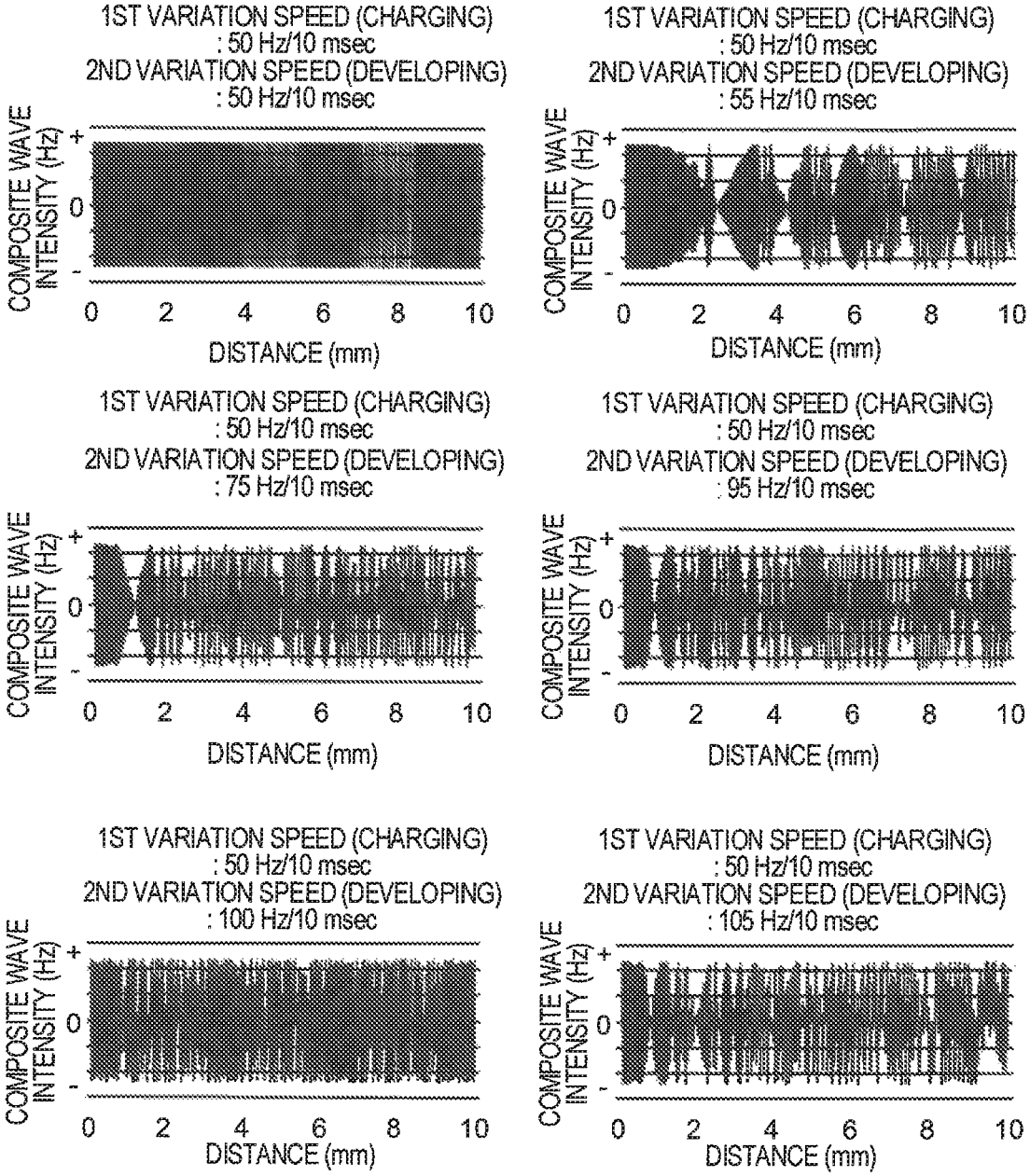
FIG. 5 comprises plots showing the results of simulations of interference between charging and developing alternating-current frequencies for different combinations of the first variation speed of the charging alternating-current frequency and the second variation speed of the developing alternating-current frequency.

FIG. 5 shows the following. In cases where, with respect to the first variation speed (50 Hz/10 msec) of the charging alternating-current frequency, the second variation speed of the developing alternating-current frequency was 55 Hz/10 msec, 75 Hz/10 msec, 95 Hz/10 msec, and 105 Hz/10 msec respectively, the peak intensity of the composite wave varied with the position in the image (the distance from the reference position). This means that nodes and antinodes of interference produced the interference fringes in the image. On the other hand, in cases where, with respect to the first variation speed (50 Hz/10 msec), the second variation speed of the developing alternating-current frequency was 50 Hz/10 msec and 100 Hz/10 msec respectively, the peak intensity of the composite wave varied little, and this can be said to indicate that suppressed interference between the charging and developing alternating-current frequencies resulted in suppressed the interference fringes. In particular in the case where the second variation speed was equal to the first variation speed, namely 50 Hz/10 msec, the peak intensity of the composite wave was generally constant irrespective of the position in the image, and this can be said to indicate that interference is suppressed effectually. The results of evaluation of interference in Table 1 match the results of simulations in FIG. 5.

Also in cases where the variation speed (second variation speed) of the developing alternating-current frequency in the variation region was set to 50 Hz/10 msec and the variation speed (first variation speed) of the charging alternating-current frequency was selected among several speeds, with respect to interference, results similar to those in Table 1 and FIG. 5 were obtained.

Thus, it can be said that, by varying the charging and developing alternating-current frequencies such that one of the first and second variation speeds is a positive-number multiple of the other, it is possible to suppress the image defects due to interference between the charging and developing alternating-current frequencies, and that making the first and second variation speeds equal is particularly effective in suppressing such image defects.

(Variable Control of the Charging Alternating-Current Frequency with Consideration Given to the Rotation Speed of Photosensitive Drum)

When, in a situation where the interference fringes appear in the developed image due to interference between the charging and developing alternating-current frequencies, the recognizable minimum pitch of the interference fringes is $W_1$ (mm), the width of the above-mentioned variation region is $X_1$ (Hz), the rotation speed of the photosensitive drum 5 is $Y_1$ (mm/sec), and the first variation speed of the charging alternating-current frequency in the variation region is $Z_1$ (Hz/sec), then it is preferable that the bias controller 33 vary the charging alternating-current frequency at a first variation speed $Z_1$ (Hz/sec) that fulfills $$|Z_1|>X_1/(W_1/Y_1). \quad (1)$$

Conditional Formula (1) above defines an adequate range of the first variation speed $Z_1$, with consideration given to the rotation speed $Y_1$ of the photosensitive drum 5, for reducing interference between the charging and developing alternating-current frequencies. That is, fulfilling Conditional Formula (1) makes it possible to vary the charging alternating-current frequency at an adequate first variation speed $Z_1$ in accordance with the rotation speed $Y_1$ of the photosensitive drum 5. It is thus possible to reduce interference between the charging and developing alternating-current frequencies in the variation region, and thereby to suppress the image defects due to the interference.

For example, if it is assumed that the recognizable minimum pitch $W_1$ of the interference fringes is 2.81 mm, that the width $X_1$ of the variation region is a range of ±2% about the center frequency of the developing alternating-current frequency, namely 2700×1.02−2700×0.98=108 Hz, and that the rotation speed $Y_1$ of the photosensitive drum 5 is $Y_1$=152 mm/sec, then $X_1/(W_1/Y_1)$=108/(2.81/152)=5842 Hz/sec (=58.42 Hz/10 msec). In this case, by varying the charging alternating-current frequency at a first variation speed $Z_1$ higher than 5842 Hz/sec, it is possible to vary the charging alternating-current frequency appropriately with respect to the rotation of the photosensitive drum 5 at the rotation speed $Y_1$, and thereby to suppress the image defects due to interference between the charging and developing alternating-current frequencies.

(Variable Control of the Developing Alternating-Current Frequency with Consideration Given to the Rotation Speed of Photosensitive Drum)

When, in a situation where the interference fringes appear in the developed image due to interference between the charging and developing alternating-current frequencies, the recognizable minimum pitch of the interference fringes is $W_2$ (mm), the width of the above-mentioned variation region is $X_2$ (Hz), the rotation speed of the photosensitive drum 5 is $Y_2$ (mm/sec), and the second variation speed of the developing alternating-current frequency in the variation region is $Z_2$ (Hz/sec), then it is preferable that the bias controller 33 vary the developing alternating-current frequency at a second variation speed $Z_2$ (Hz/sec) that fulfills $$|Z_2|>X_2/(W_2/Y_2). \quad (2)$$

Conditional Formula (2) above defines an adequate range of the second variation speed $Z_2$, with consideration given to the rotation speed $Y_2$ of the photosensitive drum 5, for reducing interference between the charging and developing alternating-current frequencies. That is, fulfilling Conditional Formula (2) makes it possible to vary the developing alternating-current frequency at an adequate second variation speed $Z_2$ in accordance with the rotation speed $Y_2$ of the photosensitive drum 5. It is thus possible to reduce interference between the charging and developing alternating-current frequencies in the variation region, and thereby to suppress the image defects due to the interference.

For example, if it is assumed that the recognizable minimum pitch $W_2$ of the interference fringes is 2.81 mm, that the width $X_2$ of the variation region is a range of ±2% about the center frequency of the charging alternating-current frequency, namely 2700×1.02−2700×0.98=108 Hz, and the rotation speed $Y_2$ of the photosensitive drum 5 is $Y_2$=152 mm/sec, then $X_2/(W_2/Y_2)$=108/(2.81/152)=5842 Hz/sec (=58.42 Hz/10 msec). In this case, by varying the developing alternating-current frequency at a second variation speed Z2 higher than 5842 Hz/sec, it is possible to vary the developing alternating-current frequency appropriately with respect to the rotation of the photosensitive drum 5 at the rotation speed Y2, and thereby to suppress the image defects due to interference between the charging and developing alternating-current frequencies.

(Variable Control of the Charging Alternating-Current Frequency with Consideration Given to the Latent Image Frequency)

If there is a deviation between the charging alternating-current frequency and the latent image frequency, which defines the resolution of the electrostatic latent image formed on the photosensitive drum 5, the charging alternating-current frequency and the latent image frequency may interfere with each other to produce the interference fringes in the developed image. Also in that case, it is possible, by controlling the charging alternating-current frequency on a principle similar to that of the above-described control based on Conditional Formula (1), to suppress the image defects due to interference between the charging alternating-current frequency and the latent image frequency. Specifically, control then proceeds as described below.

While the interference fringes that appear in the developed image due to interference between the charging and developing alternating-current frequencies are referred to as first interference fringes, interference fringes that appear in the developed image due to interference between the latent image frequency and the charging alternating-current frequency are referred to as second interference fringes. When the recognizable minimum pitch of the second interference fringes is $W_3$ (mm), the width of the variation region of the charging alternating-current frequency when the second interference fringes appear in the image is $X_3$ (Hz), the rotation speed of the photosensitive drum 5 is $Y_3$ (mm/sec), and the variation speed of the charging alternating-current frequency in the variation region is a third variation speed $Z_3$ (Hz/sec), then it is preferable that the bias controller 33 vary the charging alternating-current frequency at a third variation speed $Z_3$ (Hz/sec) that fulfills $$|Z_3|>X_3/(W_3/Y_3). \quad (3)$$

Conditional Formula (3) above defines an adequate range of the third variation speed $Z_3$ of the charging alternating-current frequency, with consideration given to the rotation speed $Y_3$ of the photosensitive drum 5, for reducing interference between the charging alternating-current frequency and the latent image frequency. That is, fulfilling Conditional Formula (3) makes it possible to vary the charging alternating-current frequency at an adequate third variation speed $Z_3$ in accordance with the rotation speed $Y_3$ of the photosensitive drum 5. This helps reduce interference between the charging alternating-current frequency and the latent image frequency in the variation region. It is thus possible to suppress not only the image defects due to interference between the charging and developing alternating-current frequencies as mentioned previous but also the image defects due to interference between the charging alternating-current frequency and the latent image frequency.

Figure 6:
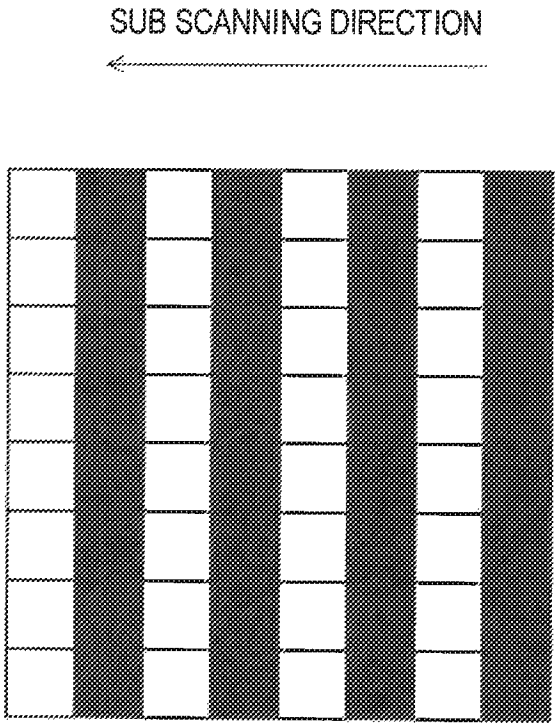
FIG. 6 is a diagram illustrating one example of an image formed along a sub scanning direction.

For example, consider a case where, as shown in FIG. 6, a one-on one-off 50% image (electrostatic latent image) Is formed along the sub scanning direction (corresponding to the peripheral direction of the photosensitive drum) at a resolution of 600 dpi, that is, a case where an image is formed every second dot along the sub scanning direction. The interval between adjacent dots along the sub scanning direction is, since one inch=2.54 cm, (2.54/600)×2=0.008466 cm=0.08466 mm. Assuming that the linear velocity of the photosensitive drum 5 is 152 mm/sec, the line interval along the sub scanning direction is 0.08466/152=0.0005565 sec. Accordingly, in this case, the latent image frequency is calculated as follows:

Latent Image Frequency (Hz)=1/Line Interval (sec)=1/0.0005565≈1795.

For example, if it is assumed that the recognizable minimum pitch $W_3$ of the second interference fringes is 3 mm, that the width $X_3$ of the variation region is from 1750 Hz to 1850 Hz, that is, 100 Hz, and that the rotation speed $Y_3$ of the photosensitive drum 5 is $Y_1$=152 mm/sec, then $X_3/(W_3/Y_3)$=100/(3/152)=5067 Hz/sec. In this case, by varying the charging alternating-current frequency at a third variation speed $Z_3$ higher than 5067 Hz/sec, it is possible to vary the charging alternating-current frequency appropriately with respect to the rotation speed of the photosensitive drum 5 at the rotation speed $Y_3$, and thereby to reduce interference between the charging alternating-current frequency and the latent image frequency in the variation region. It is thus possible to suppress the image defects due to interference between the charging alternating-current frequency and the latent image frequency.

In a case where the variation region of the charging alternating-current frequency when the first interference fringes appear in an image and the variation region of the charging alternating-current frequency when the second interference fringes appear in the image overlap, in the region (frequency variation range) where they overlap, the charging alternating-current frequency can be varied at a variation speed that fulfills Conditional Formulae (1) and (3) simultaneously, that is, at the higher of $Z_1$ and $Z_3$.

(Variable Control of the Developing Alternating-Current Frequency with Consideration Given to the Latent Image Frequency)

Likewise, if there is a deviation between the developing alternating-current frequency and the latent image frequency, the developing alternating-current frequency and the latent image frequency may interfere with each other to produce the interference fringes in the developed image. Also in that case, it is possible, by controlling the developing alternating-current frequency on a principle similar to that of the above-described control based on Conditional Formula (2), to suppress the image defects due to interference between the developing alternating-current frequency and the latent image frequency. Specifically, control then proceeds as described below.

While the interference fringes that appear in the developed image due to interference between the charging and developing alternating-current frequencies are referred to as first interference fringes, interference fringes that appear in the developed image due to interference between the latent image frequency and the developing alternating-current frequency are referred to as third interference fringes. When the recognizable minimum pitch of the third interference fringes is $W_4$ (mm), the width of the variation region when the third interference fringes appear in the image is $X_4$ (Hz), the rotation speed of the photosensitive drum 5 is $Y_4$ (mm/sec), and the variation speed of the developing alternating-current frequency in the variation region is a fourth variation speed $Z_4$ (Hz/sec), then it is preferable that the bias controller 33 vary the developing alternating-current frequency at a fourth variation speed $Z_4$ (Hz/sec) that fulfills $$|Z_4|>X_4/(W_4/Y_4). \quad (4)$$

Conditional Formula (4) above defines an adequate range of the fourth variation speed $Z_4$ of the developing alternating-current frequency, with consideration given to the rotation speed $Y_4$ of the photosensitive drum 5, for reducing interference between the developing alternating-current frequency and the latent image frequency. That is, fulfilling Conditional Formula (4) makes it possible to vary the developing alternating-current frequency at an adequate fourth variation speed $Z_4$ in accordance with the rotation speed $Y_4$ of the photosensitive drum 5. This helps reduce interference between the developing alternating-current frequency and the latent image frequency in the variation region. It is thus possible to suppress not only the image defects due to interference between the charging and developing alternating-current frequencies as mentioned previously but also the image defects due to interference between the developing alternating-current frequency and the latent image frequency.

For example, consider a case where, as shown in FIG. 6, a one-on one-off 50% image (electrostatic latent image) is formed along the sub scanning direction (corresponding to the peripheral direction of the photosensitive drum) at a resolution of 600 dpi, assuming that the latent image frequency is 1795 Hz as in the case discussed previously. If it is assumed that the recognizable minimum pitch $W_4$ of the third interference fringes is 3 mm, that the width $X_4$ of the variation region is from 1750 Hz to 1850 Hz, that is, 100 Hz, and that the rotation speed $Y_4$ of the photosensitive drum 5 is $Y_4$=152 mm/sec, then $X_4/(W_4/Y_4)$=100/(3/152)=5067 Hz/sec. In this case, by varying the developing alternating-current frequency at a fourth variation speed $Z_4$ higher than 5067 Hz/sec, it is possible to vary the developing alternating-current frequency appropriately with respect to the rotation speed of the photosensitive drum 5 at the rotation speed $Y_4$, and thereby to reduce interference between the developing alternating-current frequency and the latent image frequency in the variation region. It is thus possible to suppress the image defects due to interference between the developing alternating-current frequency and the latent image frequency.

In a case where the variation region of the developing alternating-current frequency when the first interference fringes appear in an image and the variation region of the developing alternating-current frequency when the third interference fringes appear in the image overlap, in the region (frequency variation range) where they overlap, the developing alternating-current frequency can be varied at a variation speed that fulfills Conditional Formulae (2) and (4) simultaneously, that is, at the higher of $Z_2$ and $Z_4$.

[Modifications]

The above embodiment deals with control in which a charging alternating-current frequency and a developing alternating-current frequency are varied as applied to a structure where a charging roller 4*a* is in contact with a photosensitive drum 5. Instead, control similar to that of the embodiment can be applied to a structure where a charging roller 4*a* and a photosensitive drum 5 are arranged with no contact between them (close together). Also then, effects similar to those of the embodiment can be obtained.

Although the above embodiment deals with an example where an amorphous silicon photoconductor is used as the photosensitive drum 5, also in a case where, for example, an organic photoconductor (OPC) is used, control similar to that in the embodiment brings effects similar to those of the embodiment.

Although the above embodiment deals with control in which a charging alternating-current frequency and a developing alternating-current frequency are varied as applied to a monochrome printer, control according to the embodiment can be applied to various image forming apparatuses such as monochrome copiers, color copiers, color printers, facsimile machines, multifunction peripherals, etc. Also then, effects similar to those of the embodiment can be obtained.

The present disclosure find applications in image forming apparatuses such as monochrome printers.

The description of an embodiment of the present disclosure given above is not meant to limit the scope of the present disclosure; what is disclosed herein can be implemented with any modifications made within the spirit of the present disclosure.

What is claimed is:

1. An image forming apparatus comprising:

a charging device that applies to a charging member a charging bias having a charging alternating-current voltage superposed on a charging direct-current voltage and that brings the charging member close to or into contact with an image carrying member to electrostatically charge a surface of the image carrying member;

an electrostatic latent image forming device that forms an electrostatic latent image on the surface of the image carrying member electrostatically charged by the charging device;

a developing device that develops the electrostatic latent image on the surface of the image carrying member with a developing bias having a developing alternating-current voltage superposed on a developing direct-current voltage; and a bias controller that varies both a charging alternating-current frequency, which is a frequency of the charging alternating-current voltage, and a developing alternating-current frequency, which is a frequency of the developing alternating-current voltage, wherein when a range of frequencies of the charging and developing alternating-current frequencies in which interference fringes appear in a developed image due to interference between the charging and developing alternating-current frequencies is taken as a variation range of frequencies and variation speeds of the charging and developing alternating-current frequencies in the variation range of frequencies are taken as a first variation speed and a second variation speed respectively, the bias controller varies the charging and developing alternating-current frequencies such that one of the first and second variation speeds is a positive-number multiple of another, when a recognizable minimum pitch of the interference fringes is $W_1$ (mm), a width of the variation range of frequencies is $X_1$ (Hz), a rotation speed of the image carrying member is $Y_1$ (mm/sec), and the first variation speed of the charging alternating-current frequency in the variation range of frequencies is $Z_1$ (Hz/sec), the bias controller varies the charging alternating-current frequency at the first variation speed $Z_1$ (Hz/sec) that fulfills $$|Z_1|>X_1/(W_1/Y_1).$$

2. The image forming apparatus according to claim 1, wherein the bias controller varies the charging and developing alternating-current frequencies such that the first and second variation speeds are equal.

3. The image forming apparatus according to claim 1, wherein the interference fringes are first interference fringes, and interference fringes that appear in the developed image due to interference between a latent image frequency, which defines a resolution of the electrostatic latent image, and the developing alternating-current frequency are third interference fringes, and when a recognizable minimum pitch of the third interference fringes is $W_4$ (mm), a width of the variation range of frequencies of the developing alternating-current frequency when the third interference fringes appear in the image is $X_4$ (Hz), a rotation speed of the image carrying member is $Y_4$ (mm/sec), and the variation speed of the developing alternating-current frequency in the variation range of frequencies is a fourth variation speed $Z_4$ (Hz/sec), the bias controller varies the developing alternating-current frequency at the fourth variation speed $Z_4$ (Hz/sec) that fulfills $$|Z_4|>X_4/(W_4/Y_4).$$

4. An image forming apparatus comprising:

a charging device that applies to a charging member a charging bias having a charging alternating-current voltage superposed on a charging direct-current voltage and that brings the charging member close to or into contact with an image carrying member to electrostatically charge a surface of the image carrying member;

an electrostatic latent image forming device that forms an electrostatic latent image on the surface of the image carrying member electrostatically charged by the charging device;

a developing device that develops the electrostatic latent image on the surface of the image carrying member with a developing bias having a developing alternating-current voltage superposed on a developing direct-current voltage; and a bias controller that varies both a charging alternating-current frequency, which is a frequency of the charging alternating-current voltage. and a developing alternating-current frequency, which is a frequency of the developing alternating-current voltage, wherein when a range of frequencies of the charging and developing alternating-current frequencies in which interference fringes appear in a developed image due to interference between the charging and developing alternating-current frequencies is taken as a variation range of frequencies and variation speeds of the charging and developing alternating-current frequencies in the variation range of frequencies are taken as a first variation speed and a second variation speed respectively, the bias controller varies the charging and developing alternating-current frequencies such that one of the first and second variation speeds is a positive-number multiple of another, when a recognizable minimum pitch of the interference fringes is $W_2$ (mm), a width of the variation range of frequencies is $X_2$ (Hz), a rotation speed of the image carrying member is $Y_2$ (mm/sec), and the second variation speed of the developing alternating-current frequency in the variation range of frequencies is $Z_2$ (Hz/sec), the bias controller varies the developing alternating-current frequency at the second variation speed $Z_2$ (Hz/sec) that fulfills $$|Z_2|>X_2/(W_2/Y_2).$$

5. An image forming apparatus comprising:

a charging device that applies to a charging member a charging bias having a charging alternating-current voltage superposed on a charging direct-current voltage and that brings the charging member close to or into contact with an image carrying member to electrostatically charge a surface of the image carrying member;

an electrostatic latent image forming device that forms an electrostatic latent image on the surface of the image carrying member electrostatically charged by the charging device:

a developing device that develops the electrostatic latent image on the surface of the image carrying member with a developing bias having a developing alternating-current voltage superposed on a developing direct-current voltage; and a bias controller that varies both a charging alternating-current frequency, which is a frequency of the charging alternating-current voltage, and a developing alternating-current frequency, which is a frequency of the developing alternating-current voltage, wherein when a range of frequencies of the charging and developing alternating-current frequencies in which interference fringes appear in a developed image due to interference between the charging and developing alternating-current frequencies is taken as a variation range of frequencies and variation speeds of the charging and developing alternating-current frequencies in the variation range of frequencies are taken as a first variation speed and a second variation speed respectively, the bias controller varies the charging and developing alternating-current frequencies such that one of the first and second variation speeds is a positive-number multiple of another, the interference fringes are first interference fringes, and interference fringes that appear in the developed image due to interference between a latent image frequency, which defines a resolution of the electrostatic latent image, and the charging alternating-current frequency are second interference fringes, and when a recognizable minimum pitch of the second interference fringes is $W_3$ (mm), a width of the variation range of frequencies of the charging alternating-current frequency when the second interference fringes appear in the image is $X_3$ (Hz), a rotation speed of the image carrying member is $Y_3$ (mm/sec), and the variation speed of the charging alternating-current frequency in the variation range of frequencies is a third variation speed $Z_3$ (Hz/sec), the bias controller varies the charging alternating-current frequency at the third variation speed $Z_3$ (Hz/sec) that fulfills $$|Z_3| > X_3/(W_3/Y_3).$$

* * * * *